United States Patent [19]

Park et al.

[11] 4,065,840

[45] Jan. 3, 1978

[54] METHOD FOR FABRICATING A DSDT TARGET

[75] Inventors: Kyu C. Park; Arnold Reisman, both of Yorktown Heights, N.Y.

[73] Assignee: International Business Machines Corporation, Armonk, N.Y.

[21] Appl. No.: 751,920

[22] Filed: Dec. 17, 1976

[51] Int. Cl.[2] ..... H01J 9/02

[52] U.S. Cl. ..... 29/25.14; 29/25.17; 29/25.18

[58] Field of Search ..... 29/25.11, 25.13, 25.14, 29/25.15, 25.16, 25.17, 25.18; 313/465

[56] References Cited

U.S. PATENT DOCUMENTS 3,886,310 5/1975 Guldberg et al. ..... 313/465 X

*Primary Examiner*—Richard B. Lazarus
*Attorney, Agent, or Firm*—Philip Young

[57] ABSTRACT

A process for the fabrication of a deformographic storage display tube (DSDT) target in which a wafer of silicon or other etchable material is used (1) as a temporary support during the generation of the active region of the target and (2) as a supporting structure for the completed target. The DSDT target structure comprises a reflection layer on a dielectric layer supported in turn on a silicon or other etchable material wafer, the wafer being etched off at its back side to expose the dielectric layer while providing an outer frame support structure made of the wafer around the edge, with the dielectric layer being etched to form pillars of the dielectric on the backside of the reflection layer, whereby the dielectric pillars enable a deformation action to occur in the region between the pillars. An inner frame support structure comprised of a similarly etched wafer, a dielectric layer and a secondary electron emission layer is fitted against the bottoms of the pillars and bonded to the outer frame support structure, thereby forming the completed target.

22 Claims, 7 Drawing Figures

METHOD FOR FABRICATING A DSDT TARGET

BACKGROUND OF THE INVENTION

1. Field of the Invention

This invention relates to a target assembly for deformographic storage display tubes (DSDT) and in particular to a method for fabricating the target structure.

2. Description of the Prior Art

The DSDT operates on the principle of generating minute deformations in a deformable material by the establishment of an electrostatic force from charges deposited by a cathode ray beam. The deformations in the material are translated via a reflection layer into a visual image by projection of the deformations through a Schlieren optical system. The construction of the DSDT provides it with a temporally and spatially controllable image persistence capability.

Target assemblies for deformographic display tubes are described, for example, in U.S. Pat. Nos. 3,636,084, 3,676,588, 3,858,080 and 3,879,630 which are assigned to the common assignee herein; and publications such as "Deformographic Material" by R. M. Ross et al; "Deformographic Film with Barrier Layer in Target Assembly" by R. J. Wohl; and "Applying Reflective Conductive Coating to a Deformable Polymer" by L. R. Yetter appearing in the IBM Technical Disclosure Bulletin, Vol. 13, No. 10, March 1971, p. 2948; Vol. 15, No. 5, October 1972, p. 1677; and Vol. 16, No. 7, December 1973, pp. 2045–46, respectively.

In some prior art deformographic target assemblies, a silver or other reflective conductive member is affixed to a deformable member made of materials such as silicone, rubber, a suitable gel, a liquid crystal or the like. The deformable material is chosen from those having low vapor pressure, low modulus of elasticity, low damping, reasonably high resistance and high stability, so that the material will not deteriorate under electron beam bombardment. Electrons from electron guns impinge on a non-conductive substrate to establish electron charges thereon in a desired electron charge pattern. The thickness of the deformable membrane increases or decreases in accordance with the strength of the electrostatic field resulting from the electron charge pattern established on the substrate, thereby affecting the reflection characteristics of the surface. Such prior art DSDT type target structures inherently involve a limited deformation sensitivity and deformation depth capability, as well as producing line-to-line interference in the deformation patterns. Known attempts to improve the deformation action of deformable membranes involve rather complex structures and fabrication procedures wherein supporting rods made of glass or bundles of fibers are spaced apart throughout the deformation material structure and a light reflecting membrane or material is stretched or placed on top of the rods.

SUMMARY OF THE INVENTION

It is an object of the present invention to provide a deformographic storage display tube target structure which provides a predefined deformation pattern to eliminate line-to-line interference. It is another object to provide a DSDT target structure which provides relatively greater deformation sensitivity and self-limiting deformation depth. It is another object to provide a DSDT target which avoids the interference between two intersecting vector images which occurs with conventional DSDT targets. It is another object to provide a method of fabricating a cellular DSDT target by using available integrated circuit processing technology. It is a further object to provide a DSDT target having an inherent structure which breaks the image up into minute resolution cells.

These and other objects are achieved by the present invention by a method for fabricating a DSDT target structure which includes depositing on a silicon or other etchable wafer a thick dielectric layer; depositing on the dielectric layer of a reflection layer, such as silver, and then etching off of the wafer from the back side so that there is exposed the dielectric layer and leaving only the wafer frame around the edge. The wafer frame has a generally circular configuration around the wafer periphery. The next step in the fabrication technique produces pillars of the dielectric layer by etching off the rest of the dielectric layer from the wafer side of the structure such that a plurality of such dielectric pillars are spaced apart across the structure. This forms the outer target structure.

An inner target support structure is formed by depositing on a relatively smaller wafer a secondary electron emission layer, and depositing on such secondary electron emission layer a thick dielectric layer. The inner support structure is completed by etching off the central portion of the wafer at its back side to thereby expose the secondary electron emission layer and leave only a frame around the wafer edge.

The final step of the fabrication process involves the insertion of the inner support structure into the outer target structure and bonding the two frames together with a suitable cement.

In this fashion, a DSDT target structure is fabricated having an inherent structure which breaks the image up into resolution cells. Deformation occurs on the reflection layer between the pillars of the dielectric, and such pillars provide the support for the thin reflection layer. Formation of the subject DSDT target structure is a relatively simple process with fewer fabrication steps than in conventional target structure fabrication. Such simple structure and fabrication is achieved according to the present invention through the use of a continuous reflecting surface on the outer face of the target with such reflecting layer contacting the dielectric support pillars directly and without the use of intervening dielectric layers. Also, the subject fabrication process employs thick and thin film deposition techniques and lithographic or evaporative delineation to achieve their structures. This enables the formation of support pillars that have no constraining relationship between the diameter or cross-sectional area of the pillar and the interpillar spacing.

DESCRIPTION OF THE PREFERRED EMBODIMENTS

Figure 1A:
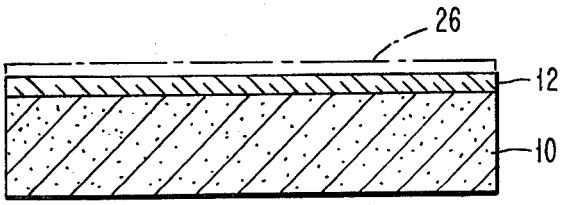
FIGS. 1A thorugh 1G show the elements of the DSDT target structure as well as the fabrication steps illustrative of the present invention.
Figure 1D:
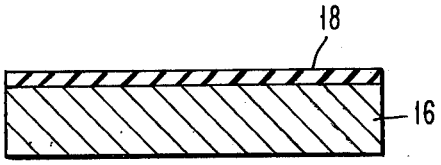
Figure 1B:
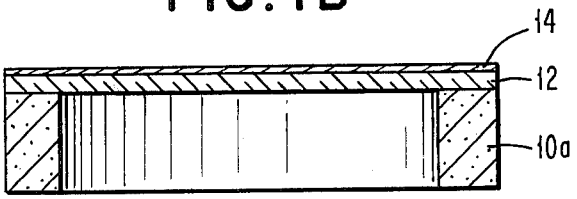
Figure 1E:
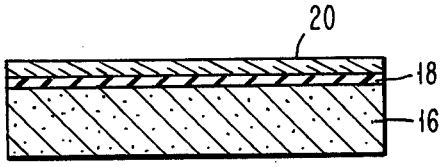
Figure 1C:
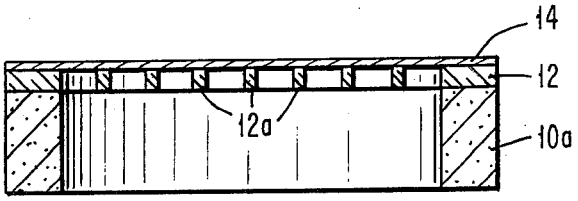
Figure 1F:
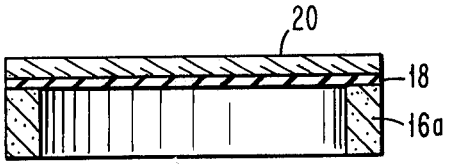
Figure 1G:
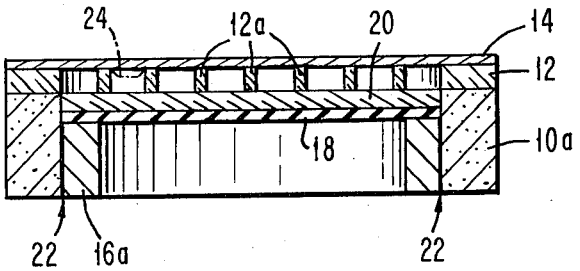

Referring to FIGS. 1A through 1G, there are shown the elements of the DSDT structure as well as the fabrication steps for the structure which is finally achieved in FIG. 1G. FIG. 1A illustrates the first step of depositing on a wafer 10 a thick dielectric layer 12 made, for example, of an evaporable borosilicate glass or $SiO_x$. The dielectric layer 12 may have a thickness in the range of, for example, 1–5 μm. The wafer 10 may be made of silicon or other similar etchable wafer.

As shown in FIG. 1B, the second step involves the deposition on the dielectric layer 12 a reflection layer 14, such as silver, and the etching off of the wafer 10 from the backside so that there is exposed the dielectric layer 12 and leaving only the wafer frame 10*a* around the edge. The wafer frame 10*a* has a generally circular configuration around the wafer periphery. The deposition of the silver reflection layer 14 as well as the deposition of the thick dielectric layer 12*a* in the first step described above, can be carried out by a vacuum deposition technique, such as E-beam, sputtering, and sputter-gun, or by any other existing technique such as CVD, spraying and anodization of pre-deposited metal layer.

FIG. 1C illustrates the third step in the fabrication technique whereby pillars 12*a* of the dielectric layer 12 are produced by etching off the rest of the dielectric layer 12 from the wafer side of the structure such that a plurality of such dielectric pillars 12*a* are spaced apart across the structure as shown with such pillars 12*a* being adhered to the reflection layer 14. A typical cross-sectional size of each pillar 12*a* is 1 mil with the center-to-center distance between pillars being in the order of 3–4 mils. The specific spacing of the dielectric pillars 12*a*, their cross-sectional area, and the thickness of the dielectric layer deposited on the wafer 10 are determined by the operating characteristics desired of the DSDT target structure. The spacing and cross-sectional area of the pillars 12*a* can be achieved using conventional mask-etching techniques and, therefore, are not detailed herein.

The first three fabrication steps described above produce what is referred to herein as an outer target structure. The following three steps to be described an inner target support structure.

FIG. 1D illustrates the fourth step of the fabrication process wherein there is deposited on a wafer 16 a secondary electron emission layer 18 made, for example, of MgO, $MgF_2$, $CeO_2$, $Y_2O_3$, or $Yb_2O_3$. Wafer 16 has a smaller diameter than the wafer 10, the difference to become apparent in the description to follow. The secondary electron emission layer 18 may be deposited with a thickness in the order of 2000–4000 A depending on the characteristics required of the target structure. Such deposition may be carried out by the same deposition techniques mentioned above for the deposition of the dielectric layer 12. In this connection, it is noted that this fourth step may be omitted from the fabrication process depending on the emission characteristics of the thick dielectric layer 12 used in the first step as well as in the next step.

FIG. 1E illustrates the fifth fabrication step wherein there is deposited on the secondary electron emission layer 18 a thick dielectric layer 20 of a material such as an evaporable borosilicate glass, or $SiO_x$. Layer 20 may have a thickness in the range of, for example, 1–5 μm. As discussed in connection with the previous step, the secondary electron emission layer 18 deposited in the fourth step described above may be omitted if the thick dielectric layer 20 possesses desired secondary electron emission characteristics. As example of a suitable electron emission characteristics for the layer 20 would be a second cross-over point of less than 7 KV and a maximum yield as high as possible.

One alternate method of depositing the dielectric layer 20 in this step is to have a sequential deposition of the secondary electron emission layer 18 followed by a deposition of the dielectric layer 20 in a vacuum system in a single pump down of the system. Furthermore, a single, thick dielectric layer with good secondary emission characteristics, e.g., $SiO_2 \times Y_2O_3$, mixture doped with a rare-earth metal, may replace both layers 18 and 20 for the fourth and fifth steps.

FIG. 1F illustrates the sixth fabrication step wherein there is etched off from the back side of the wafer 16 the central portion of such wafer to thereby expose the secondary electron emission layer 18 and leave only a frame 16*a* around the wafer edge. The etching process can be accomplished by conventional etching techniques such as the use of pyrocatechol-ethylenediamine solutions.

FIG. 1G illustrates the seventh and final step of the fabrication process wherein the inner target support structures obtained in the sixth step shown in FIG. 1F is inserted into the outer target structure obtained in the third step shown in FIG. 1C, the two frames being bonded together with a suitable cement 22, such as solder glass, in the area where the outer circumference where the wafer frame 16*a* fittingly engages in contact with the inner circumferential surface of the relatively larger wafer frame 10*a*.

In this fashion, a DSDT target structure is fabricated having an inherent structure which breaks the image up into resolution cells. Deformation occurs on the reflection layer 14 between the pillars 12*a* of the dielectric 12, as illustrated in FIG. 1G by the dotted line 24, with such pillars providing support for the thin reflection layer 14. For a large Si wafer target in the order of 3–4 inches diameter, about 1 mil diameter pillars are provided on 3–4 mil centers, providing a high yield with significantly more resolution elements than the conventional DSDT image. It is to be understood that the drawings are presented for illustrative purposes only and should not be construed as showing the actual size relationships of the elements of the DSDT structure. For example, a typical Si wafer target having the above-mentioned pillars on 3–4 mil centers would actually involve in the order of 100 times the number of pillars 12*a* extending across the wafer than the number shown in FIGS. 1C and 1G.

The steps of depositing the dielectric layer 12 of borosilicate glass on the wafer 10 or the dielectric layer 20 on the secondary electron emission layer 18 can be carried out by the method disclosed in United States patent application Ser. No. 703,382 filed on July 7, 1976 by K. C. Park (a co-inventor of the present application) and E. J. Weitzman and assigned to the assignee of this application.

Such method includes providing a scanning electron beam for heating a source of borosilicate glass in an evacuated chamber to a uniform molten pool whose surface area is approximately 2 to $10cm^2$ so as to provide a stream of evaporated source material. The wafer 10 or the secondary electron emission layer 18 constituting the substrate is then located in the path of the glass stream so that a layer of borosilicate glass is deposited on the substrate. The substrate is shielded from the stream until the latter has attained a uniform evaporation rate. The substrate is maintained at a temperature of 200° to 300° C during such deposition. Also, the source of borosilicate glass is evaporated at a rate equivalent to 40–80 A/sec. as measured at approximately 10 inches away from said source. Deposition continues until the appropriate dielectric thickness, in the order of 1–5 μm, is achieved. The chamber is evacuated to a pressure of the order of $10^{-6}$ torr during the evaporation of the borosilicate glass. Also, the source of borosilicate glass is composed of at least 83% by weight of $SiO_2$, 11% by weight of $B_2O_3$, 2.5% by weight of $Al_2O_3$, and 2.2% by weight of $Na_2O$.

A support for the thin reflection layer 14 as well as an etching barrier for the thick dielectric layer 12 during the formation of the pillars 12*a* in the third step and can be provided by adding a step between the first and second steps shown in FIGS. 1A and 1B. This is accomplished by introducing a thin insulating layer, shown as a dotted line 26 in FIG. 1A. Thus, the insulating layer 26 not only supports the reflection layer 14 but will also act as an etching barrier for the dielectric layer 12 as the etchant is applied to the dielectric during the pillar formation step shown in FIG. 1C.

Another alternative procedure for protecting the thin reflection layer 14 involves the coating of such reflection layer with an either soluble or an etchable layer, not shown, after the second step shown in FIG. 1B, and then subsequently removing this coating after the final assembly of the target structure shown in FIG. 1G. This coating acts to support the reflection layer during the assembly process by adding some body thereto and helps retain the pillars 12*a* in formation after the third step shown in FIG. 1C is performed. Of course, the subsequent assembly steps provide a rigid supporting frame made up of the wafer frame 16*a*, the thick dielectric layer 20 and the secondary electron emission layer 18, when employed.

In this fashion, there is provided a DSDT target structure which includes a thick dielectric layer on the silicon or other etchable material, with the etchable material being etched at its back side to expose the dielectric layer while providing an outer frame support structure made of the etchable material around the edge. The dielectric layer is etched to form pillars thereof between the reflection layer and the etchable material such that the dielectric pillars provide a deformation action in the region between the pillars. In addition, an inner support structure is formed of a thick dielectric layer on an etchable material and bonded to the outer frame support structure to form the composite target structure. The inherent structure of the present invention breaks the image up into resolution cells, allowing deformation to take place on the reflection layers between pillars of a dielectric. This involves a relatively simple process with fewer fabrication steps than in conventional target structure fabrication. Such simple structure and fabrication is achieved according to the present invention through the use of a continuous reflecting surface on the outer face of the target with such reflecting layer contacting the dielectric support pillars directly and without the use of intervening dielectric layers. Also, the subject target structure incorporates a secondary back side emission layer supported upon the dielectric layer and contacting the pillars 12*a* on their underside.

The subject fabrication process employs thick and thin film deposition techniques and lithographic or evaporation delineation to achieve their structures. This enables the formation of support pillars that have no constraining relationship between the diameter or cross-sectional area of the pillar and the interpillar spacing.

While the invention has been particularly shown and described with reference to preferred embodiments thereof, it will be understood by those skilled in the art that various changes in form and details may be made therein without departing from the spirit and scope of the invention.

We claim:

1. Method of fabricating a DSDT target structure, comprising:

a. depositing a first dielectric layer on an etchable first wafer;

b. depositing a reflection layer on said first dielectric layer;

c. etching off the central portion of said first wafer from the back side to expose the dielectric layer and leave a supporting wafer frame around the layer edge; and d. etching off said first dielectric layer from the wafer side to produce a plurality of pillars of said dielectric, said dielectric pillars being spaced apart across the area of said reflection layer;

e. depositing a secondary electron emission layer on an etchable second wafer;

f. depositing on said secondary electron emission layer a second dielectric layer;

g. etching off the central portion of said second wafer to expose said secondary electron emission layer and leave a supporting wafer frame around the layer edge, the outer diameter of said supporting wafer frame of said second wafer being about the same size as the inner diameter of said supporting wafer frame of said first wafer so that said second wafer fits into said first wafer; and h. bonding the two supporting wafer frames of said respective first and second wafers to one another with the ends of said dielectric pillars adjacent said second dielectric layer; whereby said dielectric pillars provide a deformation action in the region between the pillars.

2. Method as recited in claim 1 wherein said step of depositing a first dielectric layer on an etchable first wafer includes depositing said dielectric layer with a thickness in the range of 1 to 5 micrometers.

3. Method as recited in claim 2 wherein said dielectric layer consists of an evaporable borosilicate glass.

4. Method as recited in claim 2 wherein said dielectric layer consists of $SiO_x$.

5. Method as recited in claim 2 wherein said step of depositing said dielectric layer is carried out by vacuum deposition.

6. Method as recited in claim 1 wherein said etchable first wafer is made of silicon.

7. Method as recited in claim 1 wherein said step of depositing a reflection layer on said first dielectric layer includes the use of silver as such reflection layer.

8. Method as recited in claim 1 wherein said step of etching off the central portion of said first wafer involves etching a circular central portion such that said supporting wafer frame is formed with a generally circular configuration.

9. Method as recited in claim 1 wherein said step of etching off said first dielectric layer to produce a plurality of dielectric pillars is carried out by masking said dielectric to form said pillars.

10. Method as recited in claim 9 wherein said dielectric pillars are formed with a cross-sectional diameter of about 1 mil.

11. Method as recited in claim 9 wherein said dielectric pillars are formed along the surface of said reflection layer and spaced apart from each other with a center-to-center distance of about 4 mils.

12. Method as recited in claim 11 wherein the length of said dielectric pillars is in the order of 1 to 5 micrometers.

13. Method as recited in claim 1 wherein said step of depositing a secondary electron emission layer on an etchable second wafer includes a secondary electron emission layer taken from any of the following: MgO, $MgF_2$, $CeO_2$, $Y_2O_3$ or $Yb_2O_3$.

14. Method as recited in claim 13 wherein said secondary electron emission layer is deposited with a thickness in the order of 2000–4000 A.

15. Method as recited in claim 1 wherein said steps of depositing a secondary electron emission layer on an etchable second wafer and said step of depositing on said secondary electron emission layer a second dielectric layer are combined into a single step of depositing on said etchable second wafer a second dielectric layer having secondary electron emission characteristics suitable for said DSDT target operation.

16. Method as recited in claim 15 wherein said second dielectric layer possesses secondary electron emission characteristics defined by a second crossover point of less than 7 kV and a maximum yield.

17. Method as recited in claim 16 wherein said second dielectric layer having secondary emission characteristics comprises $SiO_2 \times Y_2O_3$ mixture doped with a rear earth metal.

18. Method as recited in claim 1 wherein said second dielectric layer has a thickness in the range of 1 to 5 micrometers.

19. Method as recited in claim 1 wherein said step of etching the back sides of said first and second wafers are carried out using pyrocatechol-ethylenediamine solutions.

20. Method as recited in claim 1 wherein said step of bonding together the two supporting wafer frames is carried out by applying a solder glass in the area where the outer cicumference of said second wafer fittingly engages in contact with the inner circumference surface of said first wafer frame.

21. Method as recited in claim 1 wherein said step of depositing said reflection layer on said first dielectric layer is preceded by an additional step of depositing an insulating layer on said first dielectric layer whereby said insulating layer both supports said reflection layer and acts as an etching barrier for said first dielectric layer.

22. Method of fabricating a DSDT target structure, comprising:

a. depositing a first dielectric layer on an etchable first wafer;
b. depositing a reflection layer on said first dielectric layer;
c. etching off the central portion of said first wafer from the back side to expose the dielectric layer and leave a supporting wafer frame around the layer edge; and
d. etching off said first dielectric layer from the wafer side to produce a plurality of pillars of said dielectric, said dielectric pillars being spaced apart across the area of said reflection layer;
e. depositing on an etchable second wafer a second dielectric layer having secondary electron emission characteristics;
f. etching off the central portion of said second wafer to expose said second dielectric layer and leave a supporting wafer frame around the layer edge, the outer diameter of said supporting wafer frame of said second wafer being about the same size as the inner diameter of said supporting wafer frame of said first wafer so that said second wafer fits into said first wafer; and
g. bonding together the two supporting wafer frames of said respective first and second wafers with the ends of said dielectric pillars adjacent said second dielectric layer; whereby said dielectric pillars provide a deformation action in the region between the pillars.

* * * * *